US011559870B2

(12) United States Patent
Jeon

(10) Patent No.: US 11,559,870 B2
(45) Date of Patent: Jan. 24, 2023

(54) HANDHELD SANDING DEVICE

(71) Applicant: Sang Nam Jeon, Incheon (KR)

(72) Inventor: Sang Nam Jeon, Incheon (KR)

( * ) Notice: Subject to any disclaimer, the term of this patent is extended or adjusted under 35 U.S.C. 154(b) by 574 days.

(21) Appl. No.: 16/611,526

(22) PCT Filed: Mar. 28, 2018

(86) PCT No.: PCT/KR2018/003645
§ 371 (c)(1),
(2) Date: Nov. 7, 2019

(87) PCT Pub. No.: WO2018/212448
PCT Pub. Date: Nov. 22, 2018

(65) Prior Publication Data

US 2020/0114485 A1 Apr. 16, 2020

(30) Foreign Application Priority Data

May 16, 2017 (KR) ..... 10-2017-0060324

(51) Int. Cl.
*B24B 23/02* (2006.01)
*B24B 47/12* (2006.01)

(52) U.S. Cl.
CPC ..... *B24B 23/02* (2013.01); *B24B 47/12* (2013.01)

(58) Field of Classification Search
CPC ..... B24B 23/02; B24B 47/12
USPC ..... 318/3, 558; 451/359
See application file for complete search history.

(56) References Cited

U.S. PATENT DOCUMENTS

| | | | | |
|---|---|---|---|---|
| 2,854,829 | A | 10/1958 | Porter | |
| 5,513,409 | A | 5/1996 | Biegel | |
| 5,964,003 | A | 10/1999 | Rogers | |
| 8,584,771 | B2 * | 11/2013 | Vollmer | B24B 23/028 173/171 |
| 9,505,119 | B2 * | 11/2016 | Chen | B24B 23/06 |
| 9,762,153 | B2 * | 9/2017 | Forster | B24B 23/028 |

FOREIGN PATENT DOCUMENTS

| | | | |
|---|---|---|---|
| EP | 2089185 | B1 | 10/2016 |
| GB | 2528935 | A | 2/2016 |
| JP | H08-252757 | A | 10/1996 |
| JP | 2014-161957 | A | 9/2014 |

(Continued)

*Primary Examiner* — David Luo
(74) *Attorney, Agent, or Firm* — Korus Patent, LLC; Seong Il Jeong

(57) ABSTRACT

A handheld sanding device according to the present invention includes: a power generation unit configured to generate rotating force for sanding operation; a power transmission unit configured to be coupled to the power generation unit, and to transmit the rotating force generated by the power generation unit; a sanding unit configured to be rotated by the rotating force, transmitted through the power transmission unit, in order to sand a sanding target surface; and a shaft coupling unit configured to connect the power transmission unit and the sanding unit to each other so that the sanding unit is freely inclined based on the power transmission unit, thereby improving the close contact between the sanding target surface and the sanding unit while making it easy to carry and also preventing the sanding target surface from being eccentrically worn during sanding operation.

8 Claims, 5 Drawing Sheets

(56) References Cited

FOREIGN PATENT DOCUMENTS

| | | | |
|---|---|---|---|
| JP | 5991439 | B2 | 9/2016 |
| KR | 10-1995-0002987 | B1 | 3/1995 |
| KR | 20-1998-0010220 | U | 5/1998 |
| KR | 20-1999-0029103 | U | 7/1999 |

* cited by examiner

HANDHELD SANDING DEVICE

TECHNICAL FIELD

The present invention relates generally to a handheld sanding device, and more specifically to a handheld sanding device in which a sanding unit is freely inclined in response to the inclination of a sanding target surface, thereby improving the close contact between the sanding target surface and the sanding unit while making it easy to carry and also preventing the sanding target surface from being eccentrically worn during sanding operation.

BACKGROUND ART

Generally, hand grinders that are easy to transport and carry are efficiently and beneficially used in small-sized grinding and machining operations, a material cutting operation, etc. for various materials in various types of industrial fields under various working environments.

A conventional grinder related to the above technology is configured in such a manner that a rotating shaft is supported on a body by a bearing, a commutator and an armature are coupled to the rotating shaft, a brush and a field magnet are attached to the inner circumference of the body of an electric motor opposite the commutator and the armature, the rotating shaft is connected to a grinder shaft configured to fasten a grinder, and a cover is disposed on one side circumference in order to prevent the scattering of the grinder.

According to the grinder, when power is applied to the electric motor, the armature rotates and drives the grinder integrated therewith, and the contact surface of an object can be ground by the contact with the object when the grinder is driven.

However, the conventional grinder is problematic in that a user must adjust the inclination with respect to the contact surface in response to the contact surface with the object and the eccentric wear of the contact surface occurs due to a load applied to the contact surface.

DISCLOSURE

Technical Problem

The present invention has been conceived to overcome the above-described problems, and an object of the present invention is to provide a handheld sanding device in which a sanding unit is freely inclined in response to the inclination of a sanding target surface, thereby improving the close contact between the sanding target surface and the sanding unit while making it easy to carry and also preventing the sanding target surface from being eccentrically worn during sanding operation.

Technical Solution

In order to accomplish the above-described object of the present invention, according to a preferred embodiment, there is provided a handheld sanding device including: a power generation unit configured to generate rotating force for sanding operation; a power transmission unit configured to be coupled to the power generation unit, and to transmit the rotating force generated by the power generation unit; a sanding unit configured to be rotated by the rotating force, transmitted through the power transmission unit, in order to sand a sanding target surface; and a shaft coupling unit configured to connect the power transmission unit and the sanding unit to each other so that the sanding unit is freely inclined based on the power transmission unit.

In this case, the shaft coupling unit includes: a fixed shaft portion including a fixed shaft configured to be coupled to the power transmission unit and to be rotated by the rotating force transmitted through the power transmission unit and a separation prevention ball configured to extend from the fixed shaft; and a rotating shaft portion including an autonomous rotation block configured to be provided with a ball movement cavity into and on which the separation prevention ball is inserted and supported so that the separation prevention ball is reciprocated or inclined and an autonomous rotation shaft configured to extend from the autonomous rotation block and to be coupled to the sanding unit.

In this case, the outer circumferential surface of the separation prevention ball is provided with a flat surface-shaped first stop surface configured to intersect a normal to an imaginary sphere, including the separation prevention ball; the inner surface of the ball movement cavity is provided with a flat surface-shaped second stop surface configured to intersect a normal to an imaginary sphere, including the ball movement cavity, to correspond to the first stop surface; and an inclined gap is formed between the separation prevention ball and the ball movement cavity so that the separation prevention ball is reciprocated and inclined within the ball movement cavity.

In this case, the separation prevention ball is brought into contact with and supported on the ball movement cavity by at least any one of two or more point contacts, two or more line contacts, and one or more surface contacts.

The handheld sanding device according to the present invention further includes a shaft fastening unit configured to maintain a state in which the power transmission unit and the fixed shaft have been coupled to each other or a state in which the autonomous rotation shaft and the sanding unit have been coupled to each other.

The handheld sanding device according to the present invention further includes an extension unit configured to connect the power generation unit and the power transmission unit to each other in order to transmit the rotating force, generated by the power generation unit, to the power transmission unit.

Advantageous Effects

In accordance with the handheld sanding device according to the present invention, the following effects may be obtained.

First, the sanding unit is freely inclined in response to the inclination of the sanding target surface, thereby improving the close contact between the sanding target surface and the sanding unit while making it easy to carry and also preventing the sanding target surface from being eccentrically worn during sanding operation.

Second, the degree of freedom of the sanding unit is secured based on the axial direction of the power transmission unit, thereby allowing the sanding unit to be freely inclined in the power transmission unit and also enabling the coupling between the power transmission unit and the sanding unit to be simplified.

Third, the rotating force transmitted to the power transmission unit may be stably transmitted to the sanding unit, and the sanding unit may be prevented from running idle with respect to the power transmission unit.

Fourth, the coupling force between two adjacent axes may be improved in the transmission of rotating force, and the transmission of rotating force may be facilitated.

Fifth, the distance between a user and the sanding target surface may be adjusted according to the location of the sanding target surface, and a stable load may be transmitted to the sanding target surface.

In particular, the transmission shaft unit and the extension shaft unit are each formed in the shape of a long rod. Accordingly, even when a user does not move or climb a ladder, the sanding unit may be brought into close contact with and supported on the sanding surface located away from the user, and thus sanding operation may be rapidly performed.

BEST MODE

An embodiment of a handheld sanding device according to the present invention will be described below with reference to the accompanying drawings. In this case, the present invention is limited or restricted by the embodiment. Furthermore, in the description of the present invention, a specific description of a well-known function or configuration may be omitted in order to make the gist of the present invention clear.

Figure 1:
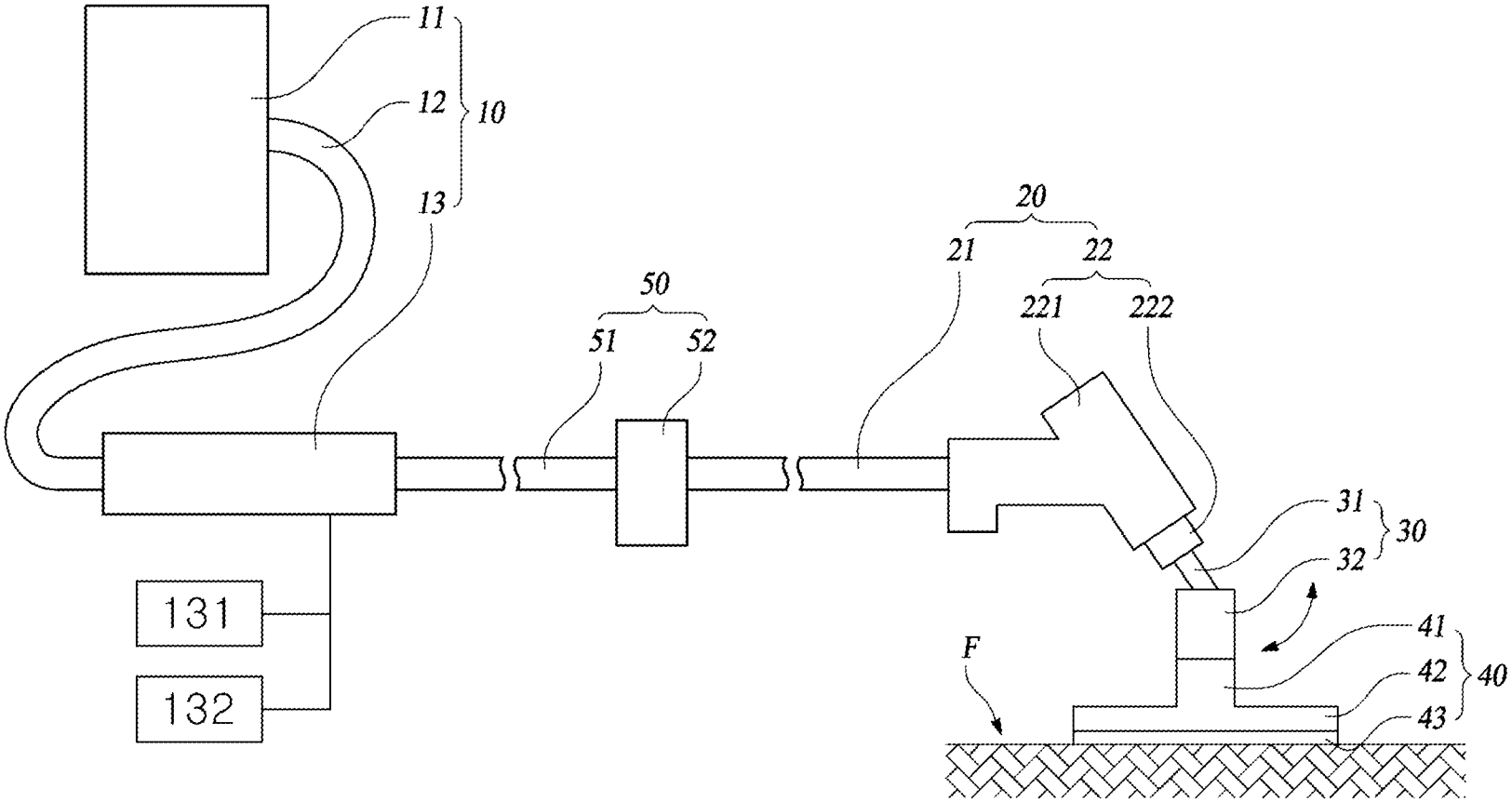
FIG. 1 is a diagram showing a handheld sanding device according to an embodiment of the present invention.
Figure 2:
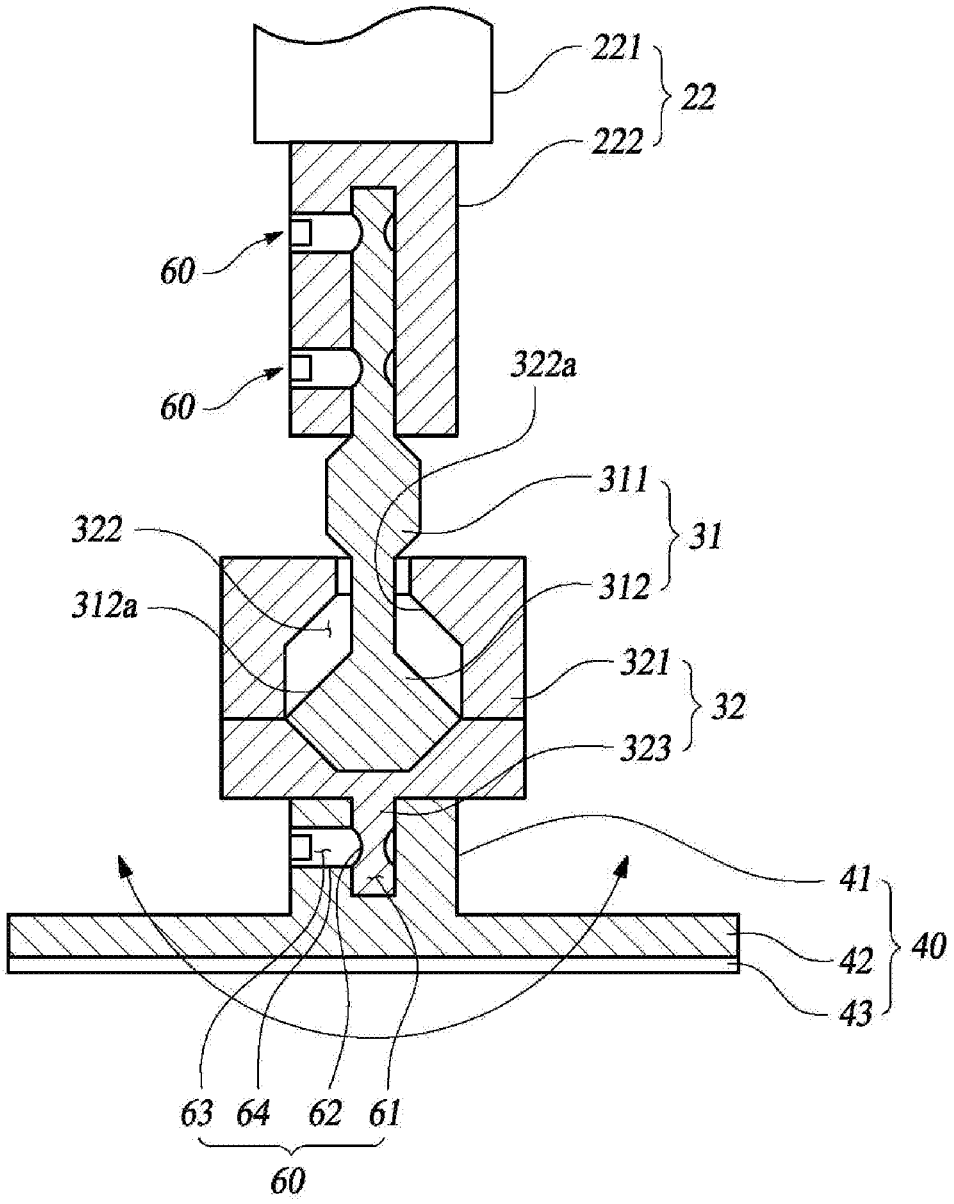
FIG. 2 is a sectional view showing structures for coupling among a power transmission unit, a shaft coupling unit, and a sanding unit in a handheld sanding device according to an embodiment of the present invention.
Figure 3:
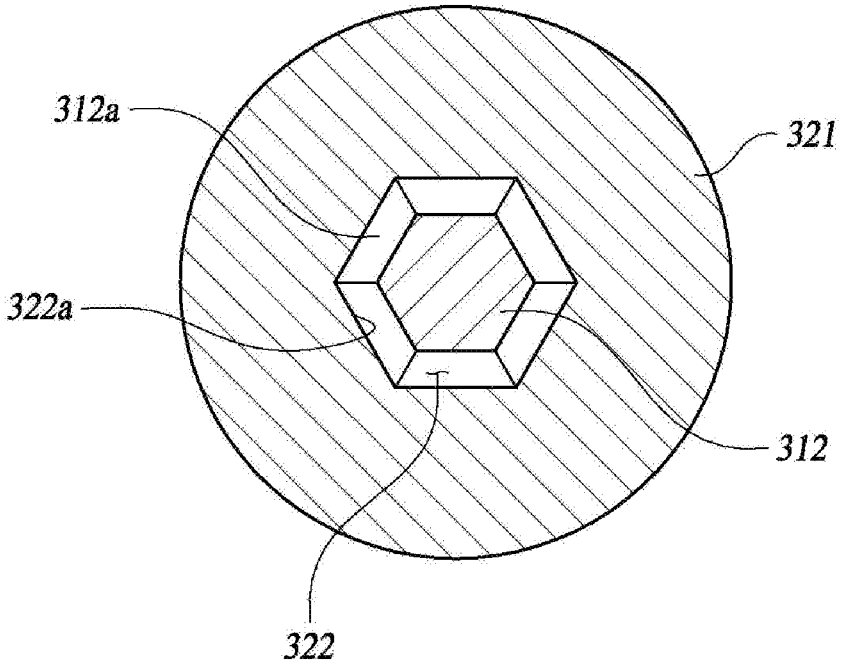
FIG. 3 is a sectional view showing a state in which the separation prevention ball of a shaft coupling unit has been inserted into a ball movement cavity in a handheld sanding device according to an embodiment of the present invention.
Figure 4:
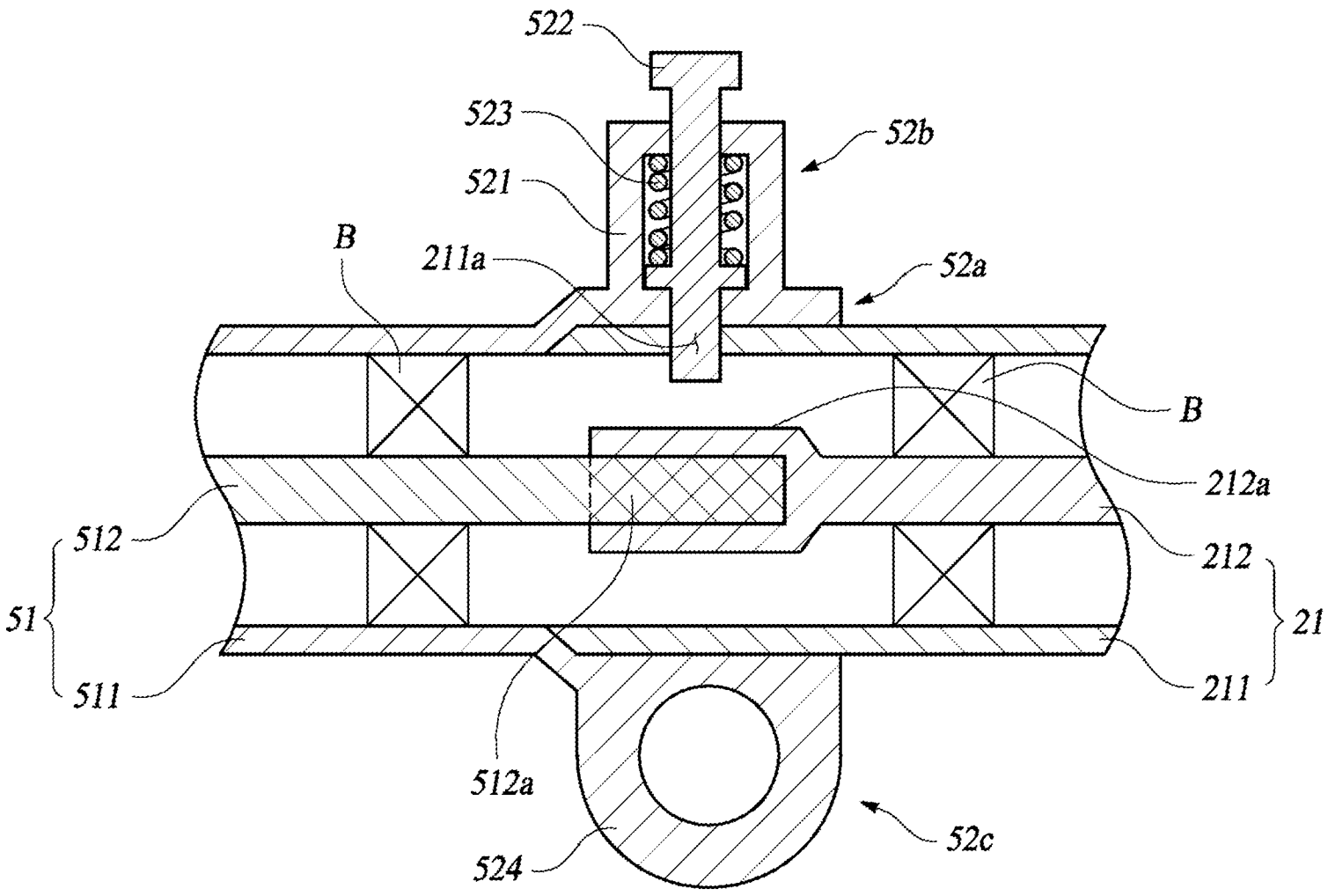
FIG. 4 is a sectional view showing a structure for coupling between a power transmission unit and an extension unit in a handheld sanding device according to an embodiment of the present invention.
Figure 5:
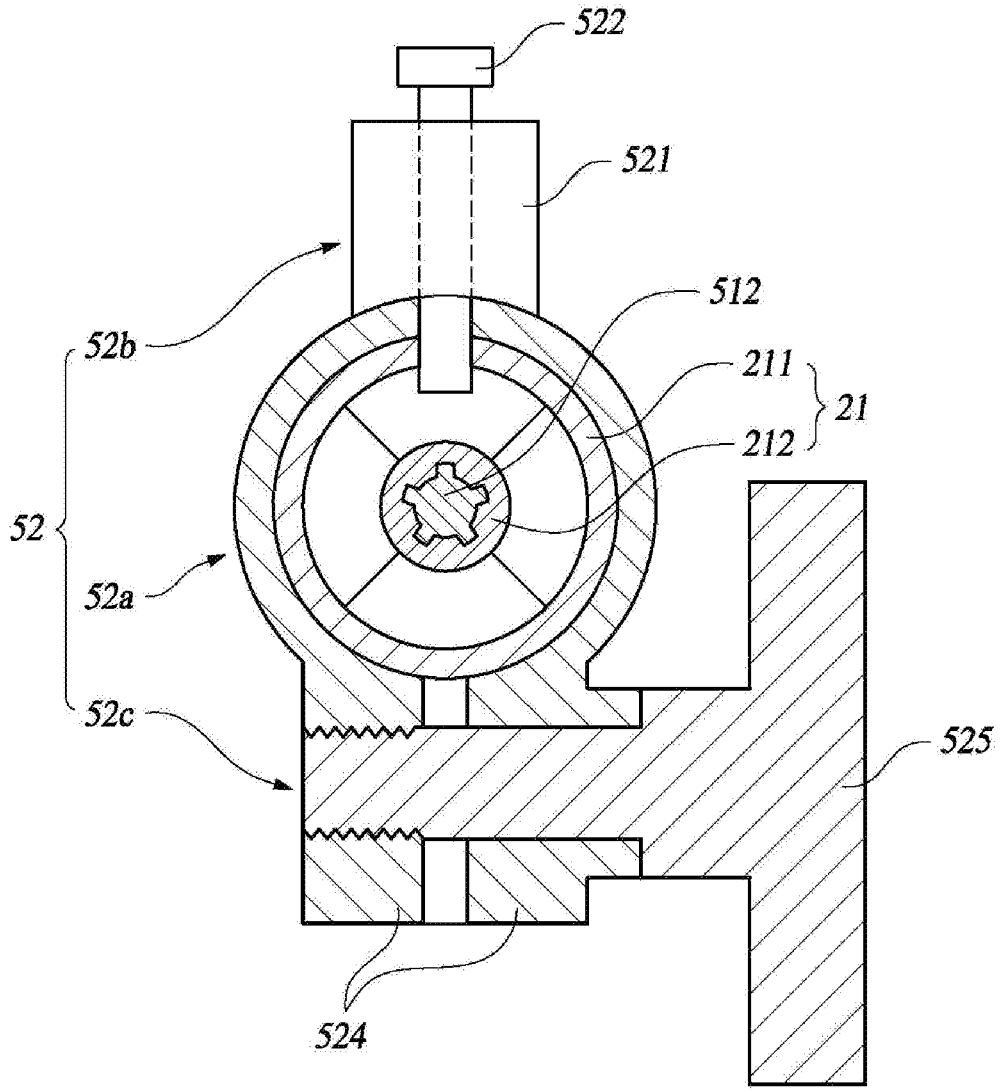
FIG. 5 is a sectional view showing a state in which a transmission shaft portion and an extension shaft portion have been connected to each other and a state in which the transmission shaft portion and an attachment unit have been connected to each other in a handheld sanding device according to an embodiment of the present invention.

Referring to FIGS. 1 to 5, a handheld sanding device according to an embodiment of the present invention includes a power generation unit 10, a sanding unit 40, a power transmission unit 20, and a shaft coupling unit 30.

The power generation unit 10 generates rotating force for sanding operation.

The power generation unit 10 may include a power generation portion 11 configured to generate a rotating force for sanding operation, a power shaft portion 12 configured to transmit the rotating force generated by the power generation portion 11, and a gripping operation portion 13 configured to be connected to the power shaft portion 12 for the gripping of a user.

The power generation portion 11 may include an engine configured to generate rotating force by using the combustion of fuel. The power generation portion 11 may include a motor configured to generate rotating force by using power charged into a battery or power applied from the outside.

The power shaft portion 12 may be configured to be freely bent, thereby enabling the location of the power transmission unit 20 to be freely set and also improving the degree of freedom of the sanding unit 40.

The gripping operation portion 13 may include an output adjustment portion 131 configured to adjust the rotating force generated by the power generation portion 11, and an emergency stop portion 132 configured to stop the rotating force of the power generation portion 11. The emergency stop portion 132 may stop the engine or motor of the power generation portion 11.

The power transmission unit 20 is coupled to the power generation unit 10. The power transmission unit 20 transmits the rotating force, generated by the power generation unit 10, to the sanding unit 40.

When an embodiment of the present invention further includes an extension unit 50, the power transmission unit is coupled to the extension unit 50. The coupling relationship between the power transmission unit 20 and the power generation unit 10 is described here. When the extension unit 50 is described, the coupling relationship between the extension unit 50 and the power transmission unit 20 and the coupling relationship between the power generation unit 10 and the extension unit 50 will be described.

The power transmission unit 20 may include a transmission shaft portion 21 configured to be coupled to the gripping operation portion 13 of the power generation unit 10 and a direction switching portion 22 configured to switch the axial direction of the transmission shaft portion 21.

The transmission shaft portion 21 may include a transmission tube portion 211 configured to be coupled to the gripping operation portion 13 of the power generation unit 10 and a transmission shaft portion 212 configured to be rotatably inserted into the transmission tube portion 211 and to be rotated by the rotating force generated by the power generation unit 10. The transmission shaft portion 212 may be rotatably inserted into the transmission tube portion 211 via a support bearing B.

The transmission tube portion 211 may be provided with a transmission hole portion 211*a* configured to be caught on and coupled to a coupling portion (not shown) provided in the gripping operation portion 13 in the state of being fitted into and coupled to the gripping operation portion 13.

The transmission shaft portion 212 may be provided with transmission splines 212*a* configured to be spline-coupled to power splines (not shown) which extend from the power shaft portion 12 and which are rotatably inserted into the gripping operation portion 13.

The direction switching portion 22 may include a direction switching block 221 configured to be coupled to the transmission tube portion 211 and to switch the axial direction of the transmission shaft portion 212, and an output shaft portion 222 configured to protrude in the axial direction switched by the direction switching block 221 and to be rotated by the rotating force transmitted through the transmission shaft portion 212.

When the transmission tube portion 211 and the gripping operation portion 13 are fitted into and coupled to each other, the power splines (not shown) and the transmission splines 212*a* are spline-coupled to each other, and the coupling portion (not shown) and the transmission hole portion 211*a* are caught on and coupled to each other.

The sanding unit 40 is rotated by rotating force, transmitted through the power transmission unit 20, in order to sand a sanding target surface.

The sanding unit 40 includes a coupling shaft portion 41 configured to be coupled to the output shaft portion 222 of the power transmission unit 20 and to be rotated by the rotating force of the output shaft portion 222, a sanding pad portion 42 configured to be coupled to the coupling shaft portion 41 in order to be supported on a sanding target surface F, and a sanding portion 43 configured to be coupled to the sanding pad portion 42 and to sand the sanding target surface F.

The coupling shaft portion 41 may represent a state of protruding from the center of the sanding pad portion 42. The sanding portion 43 can be separably attached to the sanding pad portion 42, thereby enabling the smooth replacement of the sanding portion 43.

The shaft coupling unit 30 couples the power transmission unit 20 and the sanding unit 40 to each other so that the sanding unit 40 can be freely inclined based on the power transmission unit 20.

When the shaft coupling unit 30 is used, the close contact between the sanding target surface F and the sanding unit 40 can be improved regardless of the location of the sanding target surface F.

The shaft coupling unit 30 may include a fixed shaft portion 31 configured to be fixed to the output shaft portion 222 of the power transmission unit 20, and a rotating shaft portion 32 configured to be fixed to the coupling shaft portion 41 of the sanding unit 40 in a state of being coupled to the fixed shaft portion 31 in order to be freely inclined based on the fixed shaft portion 31. The fixed shaft portion 31 may reciprocate in the longitudinal direction of the rotating shaft portion 32.

The fixed shaft portion 31 may include a fixed shaft 311 configured to be coupled to the output shaft portion 222 of the power transmission unit 20 and to be rotated by the rotating force transmitted through the power transmission unit 20, and a separation prevention ball 312 configured to extend from the fixed shaft 311.

The rotating shaft portion 32 may include an autonomous rotation block 321 provided with a ball movement cavity 322 configured to receive and support the separation prevention ball 312 so that the separation prevention ball 312 can be reciprocated or inclined, and an autonomous rotation shaft 323 configured to extend from the autonomous rotation block 321 and to be coupled to the coupling shaft portion 41 of the sanding unit 40.

In this case, the outer circumferential surface of the separation prevention ball 312 is provided with a flat surface-shaped first stop surface 312*a* configured to intersect a normal to an imaginary sphere including the separation prevention ball 312, and the inner surface of the ball movement cavity 322 is provided with a flat surface-shaped second stop surface 322*a* configured to intersect a normal to an imaginary sphere, including the ball movement cavity 322, to correspond to the first stop surface 312*a*. In this case, an inclined gap is formed between the separation prevention ball 312 and the ball movement cavity 322 so that the separation prevention ball 312 can be reciprocated and inclined within the ball movement cavity 322, so that the separation prevention ball 312 can be reciprocated along the depth direction of the ball movement cavity 322 or can be inclined within the ball movement cavity 322 in a state of being inserted into the ball movement cavity 322.

Furthermore, the separation prevention ball 312 is brought into contact with and supported on the ball movement cavity 322 by at least any one of two or more point contacts, two or more line contacts, and one or more surface contacts, so that the rotating force transmitted to the fixed shaft 311 can be stably transmitted to the autonomous rotation shaft 323 and the separation prevention ball 312 can be prevented from running idle within the ball movement cavity 322.

In this case, the handheld sanding device according to an embodiment of the present invention may further include a shaft fastening unit 60.

The shaft fastening unit 60 may maintain a state in which the autonomous rotation shaft 323 and the sanding unit have been coupled to each other. In this case, the autonomous rotation shaft 323 is fitted into and coupled to the coupling shaft portion 41 of the sanding unit 40.

As an example, when the autonomous rotation shaft 323 is inserted into the coupling shaft portion 41, the shaft fastening unit 60 may include a shaft fitting depression portion 61 depressed into the coupling shaft portion 41 such that the autonomous rotation shaft 323 can be fitted thereinto and coupled thereto, a shaft fastening depression portion 62 depressed into the circumferential surface of the autonomous rotation shaft 323, a shaft fastening screw hole portion 63 formed through the coupling shaft portion 41 to communicate with the shaft fastening depression portion 62 in a state in which the autonomous rotation shaft 323 has been inserted into the shaft fitting depression portion 61, and a shaft fastening screw portion 64 configured to be screwed into the shaft fastening screw hole portion 63 such that it is inserted into and supported on the shaft fastening depression portion 62.

As another example, when the coupling shaft portion 41 is inserted into the autonomous rotation shaft 323, the shaft fastening unit 60 may include a shaft fitting depression portion 61 depressed into the autonomous rotation shaft 323 such that the coupling shaft portion 41 can be fitted thereinto and coupled thereto, a shaft fastening depression portion 62 depressed into the circumferential surface of the coupling shaft portion 41, a shaft fastening screw hole portion 63 formed through the autonomous rotation shaft 323 to communicate with the shaft fastening depression portion 62 in a state in which the coupling shaft portion 41 has been inserted into the shaft fitting depression portion 61, and a shaft fastening screw portion 64 configured to be screwed into the shaft fastening screw hole portion 63 such that it is inserted into and supported on the shaft fastening depression portion 62.

In the same manner, the shaft fastening unit 60 may maintain a state in which the power transmission unit 20 and the fixed shaft 311 have been coupled to each other.

As an example, when the fixed shaft 311 is inserted into the output shaft portion 222, the shaft fastening unit may include a shaft fitting depression portion 61 depressed into the output shaft portion 222 so that the fixed shaft 311 is fitted thereinto and coupled thereto, a shaft fastening depression portion 62 depressed into the circumferential surface of the fixed shaft 311, a shaft fastening screw hole portion 63 formed through the output shaft portion 222 to communicate with the shaft fastening depression portion 62 in a state in which the fixed shaft 311 has been inserted into the shaft fitting depression portion 61, and a shaft fastening screw portion 64 configured to be screwed into the shaft fastening screw hole portion 63 such that it can be inserted into and supported on the shaft fastening depression portion 62.

As another example, when the output shaft portion 222 is inserted into the fixed shaft 311, the shaft fastening unit 60 may include a shaft fitting depression portion 61 depressed into the fixed shaft 311 so that the output shaft portion 222 is fitted thereinto and coupled thereto, a shaft fastening depression portion 62 depressed into the circumferential surface of the output shaft portion 222, a shaft fastening screw hole portion 63 formed through the fixed shaft 311 to communicate with the shaft fastening depression portion 62 in a state in which the output shaft portion 222 has been inserted into the shaft fitting depression portion 61, and a shaft fastening screw portion 64 configured to be screwed into the shaft fastening screw hole portion 63 such that it can be inserted into and supported on the shaft fastening depression portion 62.

The handheld sanding device according to an embodiment of the present invention may further include the extension unit 50.

The extension unit 50 connects the power generation unit 10 and the power transmission unit 20 to each other in order to transmit the rotating force, generated by the power generation unit 10, to the power transmission unit 20. The extension unit 50 may be used when the sanding target surface F is disposed further from a user than a preset location. When the extension unit 50 is used, the user may rapidly perform the operation of sanding the sanding target surface F without moving separately or using a ladder.

One side of the extension unit 50 is coupled to the gripping operation portion 13 of the power generation unit 10, and the other side is coupled to the extension unit 50 of the power transmission unit 20.

The extension unit 50 may include an extension shaft unit 51 configured to be coupled to the gripping operation portion 13, and an attachment unit 52 configured to fasten the transmission shaft portion 21 of the power transmission unit 20 to the extension shaft unit 51.

The extension shaft unit 51 may include an extension tube portion 511 configured to be coupled to the gripping operation portion 13 of the power generation unit 10, and an extension shaft portion 512 configured to be rotatably inserted into the extension tube portion 511 and to be rotated by the rotating force generated by the power generation unit 10. The extension shaft portion 512 may be rotatably inserted into the extension tube portion 511 via the support bearing B.

Although not shown, the extension tube portion 511 is provided with an extension hole portion (not shown) configured to be caught on and coupled to a coupling portion (not shown) provided on the gripping operation portion 13 in a state of being fitted into and coupled to the gripping operation portion 13, like the transmission tube portion 211.

Although not shown, the extension shaft portion 512 may be provided with coupling splines (not shown) configured to be spline-coupled to power splines (not shown) which extend from the power shaft portion 12 and which are rotatably inserted into the gripping operation portion 13.

Furthermore, the extension shaft portion 512 is provided with extension splines 512*a* which are spline-coupled to the transmission splines 212*a* of the power transmission unit 20. Then, both ends of the extension shaft portion 512 are provided with the coupling splines (not shown) and the extension splines 512*a*, respectively. The attachment unit 52 may include an attachment body unit 52*a* configured such that the transmission tube portion 211 can be inserted thereinto in a state of being integrated with the extension tube portion 511, an attachment lever unit 52*b* configured to be caught on and coupled to the transmission hole portion 211*a* provided in the transmission tube portion 211, and an attachment fastening unit 52*c* configured to press and fasten the transmission tube portion 211 inserted into the attachment body unit 52*a*.

In this case, the attachment lever unit 52*b* may include an attachment support portion 521 provided on the attachment body unit 52*a*, an attachment rod portion 522 reciprocally coupled to the attachment support portion 521 such that it is caught on and coupled to the transmission hole portion 211*a* provided through the transmission tube portion 211, and an attachment elastic portion 523 configured to elastically support the attachment rod portion 522 inside the attachment support portion 521 such that a state in which the transmission hole portion 211*a* provided through the transmission tube portion 211 and the attachment rod portion 522 are caught on and coupled to each other.

When the attachment rod portion 522 is pulled, the attachment elastic portion 523 is elastically pressed, and the attachment rod portion 522 is separated from the transmission hole portion 211*a*. When the force exerted on the attachment rod portion 522 is removed, the attachment rod portion is returned to its original location by the elastic force of the attachment elastic portion 523.

Furthermore, the attachment fastening unit 52*c* may include a pair of adjustment fork portions 524 configured to protrude from the cutaway portion of the attachment body unit 52*a* to face each other, and a pressing screw portion 525 configured to be screwed to the adjustment fork portion 524 and to adjust the interval between the adjustment fork portions 524.

When the extension tube portion 511 and the gripping operation portion 13 are fitted into and coupled to each other, the power splines (not shown) and the coupling splines (not shown) are spline-coupled to each other, and the coupling portion (not shown) and the extension hole portion (not shown) are caught on and coupled to each other.

Furthermore, when the transmission tube portion 211 and the attachment body unit 52*a* are fitted into and coupled to each other, the extension splines 512*a* and the transmission spline 212*a* are spline-coupled to each other, and the attachment rod portion 522 of the attachment lever unit 52*b* is caught on and coupled to the transmission hole portion 211*a*. Finally, the attachment body unit 52*a* may press and support the transmission tube portion 211 through the screw coupling between the pressing screw portion 525 and the adjustment fork portion 524.

From now on, the operation of a handheld sanding device according to an embodiment of the present invention will be described.

The output shaft portion 222 of the power transmission unit 20 and the coupling shaft portion 41 of the sanding unit 40 are connected via the shaft coupling unit 30. In this case, the rotating shaft portion 32 may be reciprocated based on the fixed shaft portion 31, and may be freely inclined.

Then, even when the sanding target surface F is not perpendicular to the axial direction of the output shaft portion 222, the sanding portion 43 may be brought into close contact with the sanding target surface F by the inclination or reciprocation of the rotating shaft portion 32.

Furthermore, the separation prevention ball 312 is brought into contact with and supported on the ball movement cavity 322 by the first stop surface 312*a* of the separation prevention ball 312 and the second stop surface 322*a* of the ball movement cavity 322, so that the transmission of rotating force from the output shaft portion 222 to the coupling shaft portion 41 is facilitated and the separation prevention ball 312 can be prevented from running idle within the ball movement cavity 322.

Although not shown in the drawings, the coupling portion (not shown) provided on the gripping operation portion 13 may be provided as the attachment unit 52. Then, the coupling portion (not shown) may include an attachment body unit 52*a* configured to receive the extension tube portion 511 or transmission tube portion 211 in a state of being integrated with the gripping operation portion 13, an attachment lever unit 52*b* configured to be caught on and coupled to the extension hole portion (not shown) provided in the extension tube portion 511 or transmission hole portion 211*a* provided in the transmission tube portion 211, and an attachment fastening unit 52*c* configured to press and fasten the extension tube portion 511 or transmission tube portion 211.

According to the above-described handheld sanding device, the following effects may be obtained.

First, the sanding unit 40 is freely inclined in response to the inclination of the sanding target surface F, thereby improving the close contact between the sanding target surface F and the sanding unit 40 while making it easy to carry and also preventing the sanding target surface F from being eccentrically worn during sanding operation.

Second, the degree of freedom of the sanding unit 40 is secured based on the axial direction of the power transmission unit 20, thereby allowing the sanding unit 40 to be freely inclined in the power transmission unit 20 and also enabling the coupling between the power transmission unit 20 and the sanding unit 40 to be simplified.

Third, the rotating force transmitted to the power transmission unit 20 may be stably transmitted to the sanding unit 40, and the sanding unit 40 may be prevented from running idle with respect to the power transmission unit 20.

Fourth, the coupling force between two adjacent axes may be improved in the transmission of rotating force, and the transmission of rotating force may be facilitated.

Fifth, the distance between a user and the sanding target surface F may be adjusted according to the location of the sanding target surface F, and a stable load may be transmitted to the sanding target surface F.

In particular, the transmission shaft unit 21 and the extension shaft unit 51 are each formed in the shape of a long rod. Accordingly, even when a user does not move or climb a ladder, the sanding unit 40 may be brought into close contact with and supported on the sanding surface F located away from the user, and thus sanding operation may be rapidly performed.

Although the preferred embodiments of the present invention have been described with reference to the drawings as described above, it will be apparent to those skilled in the art that the present invention may be modified or changed in various manners without departing from the spirit and scope of the present invention described in the attached claims.

The invention claimed is:

1. A handheld sanding device comprising:

a power generation unit configured to generate rotating force for sanding operation;

a power transmission unit configured to be coupled to the power generation unit, and to transmit the rotating force generated by the power generation unit;

a sanding unit configured to be rotated by the rotating force, transmitted through the power transmission unit, in order to sand a sanding target surface; and a shaft coupling unit configured to connect the power transmission unit and the sanding unit to each other so that the sanding unit is freely inclined based on the power transmission unit, wherein the shaft coupling unit comprises:

a fixed shaft portion comprising a fixed shaft configured to be coupled to the power transmission unit and to be rotated by the rotating force transmitted through the power transmission unit and a separation prevention ball configured to extend from the fixed shaft; and a rotating shaft portion comprising an autonomous rotation block configured to be provided with a ball movement cavity into and on which the separation prevention ball is inserted and supported so that the separation prevention ball is reciprocated or inclined and an autonomous rotation shaft configured to extend from the autonomous rotation block and to be coupled to the sanding unit.

2. The handheld sanding device of claim 1, wherein:

an outer circumferential surface of the separation prevention ball is provided with a flat surface-shaped first stop surface configured to intersect a normal to an imaginary sphere, including the separation prevention ball;

an inner surface of the ball movement cavity is provided with a flat surface-shaped second stop surface configured to intersect a normal to an imaginary sphere, including the ball movement cavity, to correspond to the first stop surface; and an inclined gap is formed between the separation prevention ball and the ball movement cavity so that the separation prevention ball is reciprocated and inclined within the ball movement cavity.

3. The handheld sanding device of claim 2, wherein the separation prevention ball is brought into contact with and supported on the ball movement cavity by at least any one of two or more point contacts, two or more line contacts, and one or more surface contacts.

4. The handheld sanding device of claim 3, further comprising an extension unit configured to connect the power generation unit and the power transmission unit to each other in order to transmit the rotating force, generated by the power generation unit, to the power transmission unit.

5. The handheld sanding device of claim 2, further comprising an extension unit configured to connect the power generation unit and the power transmission unit to each other in order to transmit the rotating force, generated by the power generation unit, to the power transmission unit.

6. The handheld sanding device of claim 1, further comprising a shaft fastening unit configured to maintain a state in which the power transmission unit and the fixed shaft have been coupled to each other or a state in which the autonomous rotation shaft and the sanding unit have been coupled to each other.

7. The handheld sanding device of claim 6, further comprising an extension unit configured to connect the power generation unit and the power transmission unit to each other in order to transmit the rotating force, generated by the power generation unit, to the power transmission unit.

8. The handheld sanding device of claim 1, further comprising an extension unit configured to connect the power generation unit and the power transmission unit to each other in order to transmit the rotating force, generated by the power generation unit, to the power transmission unit.

* * * * *